US006623899B2

(12) United States Patent
Takaya et al.

(10) Patent No.: US 6,623,899 B2
(45) Date of Patent: Sep. 23, 2003

(54) ELECTROPHOTOGRAPHIC PHOTOSENSITIVE MEMBER, PROCESS FOR PRODUCTION THEREOF, PROCESS CARTRIDGE AND ELECTROPHOTOGRAPHIC APPARATUS

(75) Inventors: Itaru Takaya, Numazu (JP); Masataka Kawahara, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/922,644

(22) Filed: Aug. 7, 2001

(65) Prior Publication Data

US 2002/0039696 A1 Apr. 4, 2002

(30) Foreign Application Priority Data

Aug. 8, 2000 (JP) ..... 2000-240189
Aug. 8, 2000 (JP) ..... 2000-240191
Aug. 8, 2000 (JP) ..... 2000-240192

(51) Int. Cl.[7] ..... G03G 5/14
(52) U.S. Cl. ..... 430/65; 430/60; 399/262
(58) Field of Search ..... 430/65, 60; 399/262

(56) References Cited

U.S. PATENT DOCUMENTS 5,660,961 A * 8/1997 Yu ..... 430/65
6,255,027 B1 * 7/2001 Wehelie et al. ..... 430/65

FOREIGN PATENT DOCUMENTS

| | | |
|---|---|---|
| JP | 48-47344 | 7/1973 |
| JP | 52-20836 | 2/1977 |
| JP | 52-25638 | 2/1977 |
| JP | 53-89435 | 8/1978 |
| JP | 54-26738 | 2/1979 |
| JP | 55-103556 | 8/1980 |
| JP | 62-272277 | 11/1987 |
| JP | 2-115858 | 4/1990 |

* cited by examiner

*Primary Examiner*—John Goodrow
(74) *Attorney, Agent, or Firm*—Fitzpatrick, Cella, Harper & Scinto

(57) ABSTRACT

An electrophotographic photosensitive member exhibiting good potential characteristic and image forming characteristic fee from difficulties, such as lower image density, black spots and fog or interference fringes in halftone images, over wide temperature and humidity environment condition, is provided by inserting a specific intermediate layer between a support and a photosensitive layer. The intermediate layer comprises at least 0.5 μm-thick layer of aggregated particles having a composition represented by formula (1) below:

$$Al_2O_3.nH_2O \quad (1),$$

wherein n is a number of at least 0 representing a degree of hydration.

13 Claims, 2 Drawing Sheets

ELECTROPHOTOGRAPHIC PHOTOSENSITIVE MEMBER, PROCESS FOR PRODUCTION THEREOF, PROCESS CARTRIDGE AND ELECTROPHOTOGRAPHIC APPARATUS

FIELD OF THE INVENTION AND RELATED ART

The present invention relates to an electrophotographic photosensitive member, particularly one characterized by including an intermediate layer containing a specific aluminum compound, a process for producing the photosensitive member, and a process cartridge and an electrophotographic apparatus including the photosensitive member.

An electrophotographic photosensitive member generally has a photosensitive layer on an electroconductive support. The photosensitive layer is generally a very thin layer and is liable to have an uneven thickness due to a surface defect or irregularity, such as damages or attachment, on the support surface. This liability is particularly serious in a currently predominant so-called function-separation type photosensitive layer which includes a charge generation layer having a very small thickness on the order of 0.5 $\mu$m and a charge transport layer. As such an ununiformity of photosensitive layer thickness naturally results in potential irregularity or sensitivity irregularity, the photosensitive layer should be formed as uniformly as possible. More specifically, such a potential irregularity or sensitivity irregularity results in images accompanied with black spotty defects (black spots) and fog.

On the other hand, as a measure for providing a sharper potential distribution of electrostatic latent image, there may be conceived of decreasing the photosensitive layer thickness of an electrophoto-graphic photosensitive member. For example, in a lamination type or function separation-type photosensitive member, charges generated in the charge generation layer are injected into the charge transport layer and moved along an electric field to the photosensitive member surface to locally neutralize the surface potential thereat, thereby forming an electrostatic latent image. In this case, if the charge transport layer thickness is reduced to increase the electric field strength and reduce the charge migration distance, the charge diffusion in directions perpendicular to the electric field can be suppressed to provide a sharp electrostatic latent image faithful to exposure light, such as digital laser beam spots. Further, if an electrophotographic photosensitive member is considered as a kind of dielectric member, a smaller photosensitive layer thickness results in a large electrostatic capacitance of the photosensitive member and correspondingly a higher charge density at the photosensitive member surface for providing a prescribed surface potential. As a result, the developing electric field is enhanced and the electrostatic latent image potential distribution is intensified to result in a higher resolution.

However, in a conventional electrophoto-graphic photosensitive member, an increased electric field intensity caused by a smaller photosensitive layer thickness has promoted charge injection from the support side, thus resulting in undesirable phenomena, such as a lower chargeability and so-called fog in the reversal development system.

Accordingly, though the photosensitive layer thickness reduction is expected to result in a higher resolution through an improved reproducibility of dots formed by digital exposure light, such as a laser beam, it is also accompanied with difficulties attributable to charge injection, thus leaving a problem for practical application.

For solving the problem, it has been proposed to insert an intermediate layer between the support and the photosensitive layer for the purpose of coating surface defects on the support, improving the adhesion between the support and the photosensitive layer and preventing the carrier injection from the support to the photosensitive layer.

Hitherto, it has been proposed to form such intermediate layers of resins, such as polyamide (JP-A 48-47344 and JP-A 52-25638), polyester (JP-A 52-20836 and JP-A 54-26738), polyurethane (JP-A 53-89435 and JP-A 2-115858), quaternary ammonium salt-containing acrylic polymer (JP-A 51-126149) and casein (JP-A 55-103556). However, an intermediate layer of a material as described above is liable to have an electrical resistance which is liable to change depending on environmental changes, so that it has been difficult to provide an electrophotographic photosensitive member having stable and excellent potential characteristics in all environmentals ranging from low temperature/low humidity to high temperature/high humidity.

For example, in the case where such an electrophotographic photosensitive member is used in a low temperature/low humidity environment liable to cause an increase in resistivity of the intermediate layer, charges are liable to remain in the intermediate layer, thus resulting in increases in light-part potential and residual potential. As a result, the resultant images are liable to be foggy in the case of normal development and are liable to be thinner in image density in the case of reversal development, so that it is difficult to continually obtain images of prescribed image quality. On the other hand, in the case where such an electrophotographic photosensitive member is used in a high temperature/high humidity environment liable to cause a lowering in resistivity of the intermediate layer, the barrier function of the intermediate layer is liable to be lowered, thus resulting in an increased carrier injection from the support and a lowering in dark-part potential. As a result, the resultant images are liable to have a lower image density in the case of normal development and are liable to be accompanied with black spots and fog in the case of reversal development.

JP-A 62-272277 has disclosed to form an intermediate layer by applying a coating liquid comprising a mixture of an organometallic compound, such as a silane coupling agent or a metal alkoxide, in an organic solvent. When such a coating film of an organic solution of a relatively low-molecular weight organometallic compound is subjected to a subsequent drying step, the organometallic compound is hydrolyzed and polymerized to form a cured film having a network structure. However, a cured film obtained through such a process is liable to be cracked at a certain thickness or larger. The resultant crack in the intermediate layer results in a thinner image formation in the normal development or black spots or fog in the reversal development. Accordingly, such an intermediate layer formed by application and curing of a coating liquid obtained by mixing of an organometallic compound in an organic solvent can only be formed in a small thickness. However, such an intermediate layer of only a small thickness is liable to exhibit an insufficient ability of preventing carrier injection from the support to the photosensitive layer, thus also resulting in a lower image density in the normal development and black spots and fog in the reversal development. Accordingly, it is very difficult to satisfy the image quality and potential characteristic in combination. Moreover, such organometallic compounds used for providing an intermediate layer coating liquid, as represented by alkoxides and acetylacetonates of zirconium, titanium and aluminum, are strongly hydrolyzable, and the coating liquid comprising such an orgametallic compound and an organic solvent is liable to cause a precipitate or a viscosity increase as by gelling, thus posing a problem in respect of storage stability.

On the other hand, there have been made a number of proposals of subjecting an aluminum substrate to anodic oxidation to form an anodized aluminum film thereon. However, the anodic oxidation requires special bath and technique which are time-consuming labored and costly.

SUMMARY OF THE INVENTION

Accordingly, a generic object of the present invention is to provide an electrophotographic photosensitive member having solved the above-mentioned problems of the prior art.

A more specific object of the present invention is to provide an electrophotographic photosensitive member including an intermediate layer which can be formed in a crack-free state inexpensively and without requiring a special technique by using a coating liquid of a good storage stability.

Another object of the present invention is to provide an electrophotographic photosensitive member including such an intermediate layer and capable of exhibiting excellent potential characteristic and image forming characteristic free from difficulties, such as lower image density or black spots and fog, over a variety of temperature and humidity environment conditions even at a smaller thickness of photosensitive layer.

Further objects of the present invention are to provide a process for producing such an electrophotographic photosensitive member, and a process cartridge and an electrophotographic apparatus including such an electrophotographic photosensitive member.

According to the present invention, there is provided an electrophotographic photosensitive member, comprising: a support, an intermediate layer and a photosensitive layer disposed in this order, wherein the intermediate layer comprises an at least 0.5 μm-thick layer of aggregated particles having a composition represented by formula (1) below:

$$Al_2O_3.nH_2O \quad (1),$$

wherein n is a number of at least 0 representing a degree of hydration.

According to the present invention, there is provided a process for forming an electrophotographic photosensitive member, comprising the steps of:

applying onto a support a dispersion liquid containing particles having a composition represented by formula (1) below:

$$Al_2O_3.nH_2O \quad (1),$$

wherein n is a number of at least 0 representing a degree of hydration, drying under heating the dispersion liquid on the support to aggregate the particles, thereby forming an intermediate layer having a thickness of at least 0.5 μm, and forming a photosensitive layer on the intermediate layer, thereby forming an electrophoto-graphic photosensitive member comprising the support, the intermediate layer and the photosensitive layer disposed in this order.

The present invention further provides a process cartridge and an electrophotographic apparatus including the above-mentioned electrophotographic photosensitive member.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
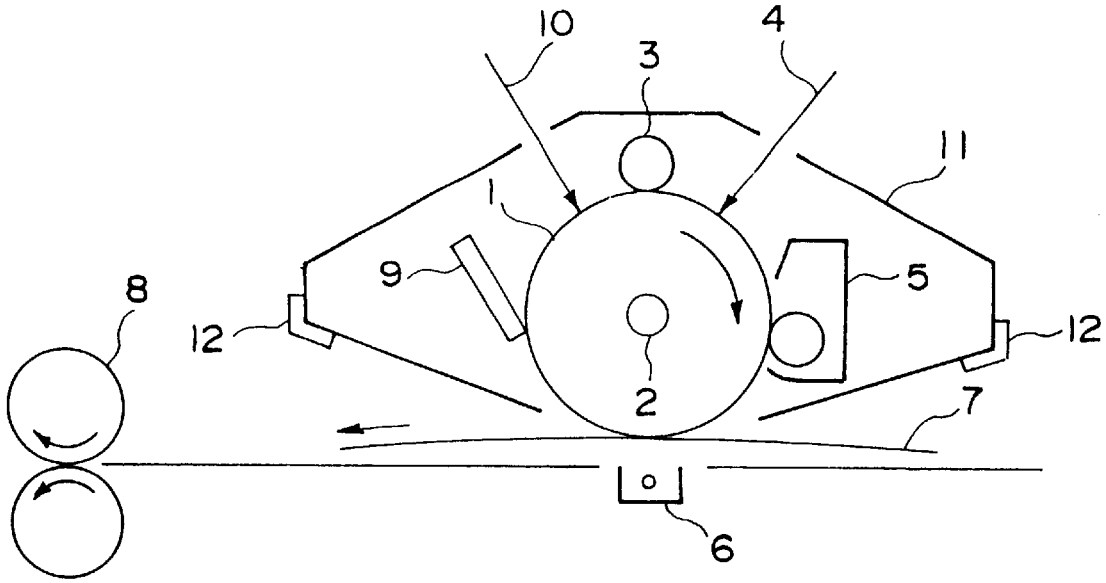
FIG. 1 is a schematic illustration of an electrophotographic apparatus including a process cartridge, which in turn includes an electrophotographic photosensitive member of the invention.

The electrophotographic photosensitive member according to the present invention comprises a support, an intermediate layer and a photosensitive layer laminated in this order, wherein the intermediate layer comprises an at least 0.5 μm-thick layer of aggregated particles having a composition represented by formula (1) below:

$$Al_2O_3.nH_2O \quad (1),$$

wherein n is a number of at least 0 representing a degree of hydration.

The intermediate layer may be formed by applying a dispersion liquid containing particles having a composition represented by the above formula (1) onto a support and drying under heating the dispersion liquid on the support to aggregate the particles and form an at least 0.5 μm-thick layer of the aggregated particles.

In the case where the intermediate layer is formed in a thickness of below 0.5 μm, image defects, such as black spots and fog are liable occur, so that the intermediate layer is formed in a thickness of at least 0.5 μm in the present invention. From the viewpoint of preventing increases in light-part potential and residual potential, the intermediate layer may preferably have a thickness of at most 5 μm. Such a layer thickness of the intermediate layer may be measured by observing a section of an electrophotographic photosensitive member through a scanning electron microscope (SEM).

The temperature for heat-drying the dispersion liquid to form an intermediate layer may preferably be in a range of 90–350° C., more preferably 120–200° C.

The above-mentioned compositional formula (1) may inclusively represent a class of alumina compounds called by material names such as alumina, alumina hydrate (aluminum hydroxide), alumina gel, emery, corundum, sapphire, diaspore, nordustrandite, hydraragillite (gibbsite), bayerite, boehmite and lucalox. Alumina is represented by a compositional formula of $Al_2O_3$ and includes transitional alumina, such as γ-alumina, δ-alumina, θ-alumina, etc., in addition to α-alumina having a corundum structure. Alumina hydrate (alumina hydroxide) includes those represented by compositional formulae of: $Al_2O_3.H_2O$, $Al_2O_3.3H_2O$ and $Al_2O_3.1/5H_2O$, such as gibbsite, bayerite, nordstrandite, boehmite, diaspore and toddite. The particles having a composition represented by the formula (1) and used for providing the intermediate layer may be commercially available ones or synthesized ones.

The materials represented by the compositional formula (1) may for example be produced through the Bayer process, pyrolysis of aluminum alum, hydrolysis of organic aluminum compounds and discharge in water of aluminum. The synthesis may preferably be performed in a medium free from impurities, such as alkali metals, alkaline earth metals or halide ions and may preferably be performed through a process using a high-purity organic aluminum compound as a starting material.

Preferred examples of the organic aluminum compound to by used as the starting material may include: alkylaluminums, such as trimethylaluminum and triethylaluminum; aluminum alkoxides, such as aluminum triethoxide, aluminum triisopropoxide and aluminum tri-sec-butoxide; and aluminum chelate compounds as represented by β-diketonate complexes, such as aluminum tri-acetylacetonate and aluminum tris(ethyl-acetoacetate).

More specifically, the particles having a composition represented by the formula (1) may for example be produced from an organic aluminum compound through pyrolysis of the organic aluminum compound under a reduced pressure or hydrolysis of the organic aluminum compound by adding water thereto. In the case of pyrolysis of an organic aluminum compound under a reduced pressure, particles of δ-alumina analogous to γ-alumina are formed at relatively low temperatures, and particles of θ-alumina or α-alumina are formed at high temperatures of 1000° C. or higher. Further, in the case of hydrolysis of an organic aluminum compound, bayerite or boehmite is formed depending on the pH of the hydrolysis medium at a temperature of from room temperature to 100° C. and is transferred into alumina by heating.

The dispersion liquid for providing an intermediate layer may be produced by subjecting the above-prepared particles to dispersion by means of a ball mill, an ultrasonic dispersor, a paint shaker, a sand mill, etc. For the provision of the intermediate layer, the particles in the coating dispersion liquid may preferably be present in fine particles having an average primary particle size of 10 nm–1 μm. In excess of 1 μm, the dispersibility is lowered to provide a dispersion liquid having a lower stability. Below 10 nm, the resultant coating layer is liable to be smaller in thickness, thus making it difficult to form an intermediate layer having a thickness of at least 0.5 μm. More preferably, the particles may exhibit an average primary particle size of 10 nm–100 nm. The average particle size may be determined as a number average of longer-axis diameters of arbitrary selected 100 particles observed through a scanning electron microscope.

The dispersion liquid for providing the intermediate layer may preferably contain a surfactant. By adding such a surfactant, it becomes possible to lower the surface tension of the dispersion liquid, thus improving the layer formability with the dispersion liquid. The surfactant may preferably be a nonionic surfactant, such as polyoxyethylene alkylphenyl ether, polyoxyethylene alkyl ether, a polyoxyethylene aliphatic acid ester. The use of a surfactant is also effective for promoting the particles at a high concentration. The surfactant may preferably be added in a proportion of 0.1–1 wt. % of the total dispersion liquid.

The intermediate layer may preferably be formed by mutual aggregation or sintering of the particles of the dispersion liquid through dehydration from the dispersion liquid to provide a cured layer. As a result, it is possible to easily provide a relatively thick intermediate layer of at least 0.5 μm with good properties. For this purpose, the dispersion liquid may preferably be an aqueous dispersion of alumina particles having a high reactivity of particle surfaces or an aqueous dispersion of boehmite or bayerite formed by hydrolysis of a hydrolyzable organic aluminum compound. It is further preferred to use particles showing boehmite phase. Particularly, boehmite particles obtained by hydrolysis of an organic aluminum compound are rich in condensable groups at particle surfaces so that a tough film can be readily formed therefrom.

Such an aqueous dispersion of boehmite particles may be formed by hydrolyzing an organic aluminum compound with a large amount water or warm water, adding an acid thereto and heating the system to cause uniform dispersion of grown particles. Further, a surfactant may be added to an aqueous system containing bayerite particles formed without such an acid addition to prepare a dispersion liquid.

Further, hydrothermal synthesis may be relied on as a process for synthesizing a material constituting boehmite particles from an organic aluminum compound. More specifically, in an autoclave or a comparable closed vessel, an organic aluminum compound is hydrolyzed and subjected to particle growth at a temperature in excess of 100° C. to provide a dispersion liquid coating boehmite particles. In the case of forming such a dispersion liquid through hydrothermal synthesis, it is generally preferred to add a surfactant for increasing the dispersibility and liquid viscosity.

In the present invention, it is particularly preferred to use a dispersion liquid containing boehmite particles formed through hydrothermal synthesis in view of electrophotographic performances of the resultant photosensitive member.

It is not preferred that an organic compound, such as a water-soluble polymer or a binder resin component, remains in the intermediate layer since such an organic compound is liable to lower the electrical resistivity in a high temperature/high humidity environment. More specifically, the residual amount of an organic compound should preferably be suppressed to at most 1 wt. % of the total intermediate layer.

The intermediate layer may preferably exhibit a surface roughness Rz (ten-point-average roughness according to JIS-B0601) of 0.1–1 μm so as to provide an improved function of preventing the occurrence of interference fringes sometimes encountered in an electrophotographic apparatus of a digital scheme using coherent light such as laser light as exposure light. The prevention of interference fringes may be achieved by scattering of exposure light and promoted in the present invention using an intermediate layer formed by aggregation of particles in a relatively large thickness suitable for providing such an appropriate level of surface roughness.

The photosensitive layer formed on the intermediate layer in the photosensitive member of the present invention may be roughly classified into a so-called single layer-type containing both a charge-generating material and a charge-transporting material in a single layer, and a so-called lamination type including a charge generation layer containing a charge-generating material and a charge transport layer containing a charge-transporting material. The lamination type is further classified into a type including the support, the charge generation layer and the charge transport layer disposed in this order, and a type including the support, the charge transport layer and the charge generation layer disposed in this order. The photosensitive layer used in the present invention may preferably be the lamination type, particularly the type including the charge transport layer disposed on the charge generation layer.

The charge generation layer may be formed by applying and drying a coating liquid formed by dispersing a charge-generating material together with a binder resin in an appropriately selected solvent. Examples of the charge-generating material may include: azo pigments, inclusive of monoazo, bisazo and trisazo pigments; phthalocyanines and non-metallic phthalocyanine; indigo pigments, such as indigo and thioindigo; polycyclic quinone pigments, such as anthanthrone and pyrenequinone; perylene pigments, such perylenic acid anhydride and perylenic acid imide; equalylium dyes; pyrylium and thiopyrylium salts; and triphenylmethane dyes. Examples of the binder resin may include: polyvinyl acetal, polystyrene, polyester, polyvinyl acetate, methacrylic resin, acrylic resin, polyvinylpyrrolidone and cellulosic resin. The charge generation layer may preferably have a thickness of at most 5 μm, more preferably 0.05–2 μm.

The charge transport layer may be formed by applying and drying a coating liquid formed by dissolving a charge-transporting material in a solution of a film-forming resin. The charge-transporting material may be roughly classified into an electron-transporting material and a hole-transporting material. Examples of the electron-transporting material may include: electron-accepting materials, such as 2,4,7-trinitrofluorenone, 2,4,5,7-tetrachlorofluorenone and chroranil, and polymerized derivatives of such electron-accepting materials. Examples of the hole-transporting-material may include: polycyclic aromatic compounds, such as pyrene and anthracene; heterocyclic compounds, such as carbazole, indole, imidazole, oxazole, thiazole, oxadiazole, pyrazole, pyrazoline, thiadiazole, and triazole; hydrazone compounds, such as p-diethyaminobenzaldehyde-N,N-diphenylhydrazone and N,N-diphenylhydrazino-3-methylidene-9-ethylcarbazole styryl compounds, such as α-phenyl-4'-N,N-diamino-stilbene and 5-[4-(di-p-tolylamino)benzylidene]-5H-dibenzo[a,d]dicycloheptene; benzidine compounds; triarylamine compounds; triphenylamine; and polymers including these compounds in their main chain or side chain, such as poly-N-vinylcarbazole and polyvinylanthracene. Examples of the film-forming resin may include: polyesters, polycarbonates, polymethacrylate esters and polystyrene. The charge transport layer may preferably have a thickness of 5 to 40 μm. more preferably 10 to 30 min. Particularly, the present invention exhibits a remarkable effect at a small thickness of 15 μm or smaller which is advantageous for providing high-resolution images but is liable to result in fog.

The single layer-type photosensitive layer may be formed by applying and drying a coating liquid formed by dispersing or dissolving the charge-generating material and the charge-transporting material together with a binder resin in a solvent. The photosensitive layer may preferably have a thickness of 5 to 40 μm, more preferably 10–30 μm. For a similar reason as the charge transport layer, the present invention is particularly effective at a photosensitive layer thickness of 15 μm or smaller.

In the present invention, it is also possible to use a photosensitive layer comprising a layer of organic photoconductive polymer, such as polyvinylcarbazole or polyvinylanthracene; a vapor-deposition layer of the above-mentioned charge-generating substance, selenium, selenium-tellurium or amorphous silicon.

The electroconductive support may for example comprise: aluminum, aluminum alloy, copper, zinc, stainless steel, titanium, nickel, indium, gold, or platinum. It is also possible to form an electroconductive support by vapor-deposition of such a metal or alloy onto a support of a plastic material, such as polyethylene, polypropylene, polyvinyl chloride, polyethylene terephthalate, or acrylic resin; coating such a support of plastic, metal or alloy with a layer of electroconductive particles (of, e.g., carbon black or silver particle) together with an appropriate binder resin; or impregnating a support of plastic or paper with electroconductive fine particles. The support may have a shape of e.g., a drum, a sheet or a belt, selected to most suit the photosensitive member to be produced.

In the case of using coherent light such as laser light as exposure light, the electroconductive support may be provided with surface unevennesses so as to prevent image deterioration due to interference, e.g., by forming unevennesses on the order of a half (½) of wavelength of the used light by dispersing e.g., silica beads or silicone-resin particles of several μm or smaller in diameter at a pitch of 10 μm or shorter. It is also possible to provide such surface unevennesses by surface roughening as by etching, blasting or cutting.

In the photosensitive member according to the present invention, the photosensitive layer can be further coated with a protective layer comprising a layer of resin alone or together with electroconductive fine particles dispersed therein.

The above-mentioned resinous layers including the photosensitive layer may be formed by various coating methods, inclusive of dipping, spray coating, beam coating, spinner coating, roller coating, wire bar coating and blade coating.

Next, some description will be made on the process cartridge and the electrophotographic apparatus according to the present invention.

FIG. 1 shows a schematic structural view of an electrophotographic apparatus including a process cartridge using an electrophotographic photosensitive member of the invention. Referring to FIG. 1, a photosensitive member 1 in the form of a drum is rotated about an axis 2 at a prescribed peripheral speed in the direction of the arrow shown inside of the photosensitive member 1. The peripheral surface of the photosensitive member 1 is uniformly charged by means of a primary charger 3 to have a prescribed positive or negative potential. At an exposure part, the photosensitive member 1 is imagewise exposed to light 4 (as by slit exposure or laser beam-scanning exposure) by using an image exposure means (not shown), whereby an electrostatic latent image is successively formed on the surface of the photosensitive member 1. The thus formed electrostatic latent image is developed by using a developing means 5 to form a toner image. The toner image is successively transferred to a transfer (-receiving) material 7 which is supplied from a supply part (not shown) to a position between the photosensitive member 1 and a transfer charger 6 in synchronism with the rotation speed of the photosensitive member 1, by means of the transfer charger 6. The transfer material 7 carrying the toner image thereon is separated from the photosensitive member 1 to be conveyed to a fixing device 8, followed by image fixing to print out the transfer material 7 as a copy outside the electrophotographic apparatus. Residual toner particles remaining on the surface of the photosensitive member 1 after the transfer operation are removed by a cleaning means 9 to provide a cleaned surface, and residual charge on the surface of the photosensitive member 1 is erased by a pre-exposure means issuing pre-exposure light 10 to prepare for the next cycle. The pre-exposure means can be omitted, as the case may be.

According to the present invention, in the electrophotographic apparatus, it is possible to integrally assemble a plurality of elements or components thereof, such as the above-mentioned photosensitive member 1, the primary charger (charging means) 3, the developing means and the cleaning means 9, and incorporate them in a container 11 to form a process cartridge, which is detachably mountable to the apparatus main body, such as a copying machine or a laser beam printer. The process cartridge may, for example, be composed of the photosensitive member 1 and at least one of the primary charging means 3, the developing means 5 and cleaning means 9, which are integrally assembled into a single unit capable of being attached to or detached from the apparatus body by the medium of a guiding means such as a rail 12 of the apparatus body.

In the case where the electrophotographic apparatus is used as a copying machine or a printer, for example, the imagewise exposure light 14 may be provided as reflected light or transmitted light from an original, or signal light obtained by reading an original by a sensor, converting the read data into signals, and scanning a laser beam or driving a light-emitting device, such as an LED array or a liquid crystal shutter array, based on the signals.

The electrophotographic photosensitive member according to the present invention may be used not only in an electrophotographic copying machine and a laser beam printer, but also in other electrophotography-applied apparatus, such as a CRT printer, an LED printer, a facsimile apparatus, a liquid crystal printer and a laser plate making.

Hereinbelow, the present invention will be described more specifically with reference to Examples and Comparative Examples wherein "parts" and "%" used for describing a relative amount of a component or a material are by weight unless specifically noted otherwise.

EXAMPLE 1

To 50 parts of boehmite particles having an average particle size (Dav) of 20 nm ("Dispal", made by Vista Chemical Co.), 200 parts of deionized water and 0.25 part of polyoxyethylene alkylphenyl ether nonionic surfactant ("EA120", made by Daiichi Kogyo Yakuhin K.K.) were added, and stirred together for 1 min., to form a coating liquid (dispersion liquid) for an intermediate layer.

Then, an aluminum cylinder (30 mm in outer diameter (OD)×254 mm in length (L), Rz (ten-point average roughness according to JIS-B0601)=0.03 $\mu$m) formed by drawing, as a support, was coated by dipping with the above-prepared coating liquid for an intermediate layer, followed by drying at 200° C. for 2 hours to form a 2.0 $\mu$m-thick intermediate layer showing a surface roughness Rz=0.5 $\mu$m.

Separately, a mixture of 4 parts of oxytitanium phthalocyanine pigment (showing strong peaks at Bragg angles (20±0.2 deg.) of 9.0 deg., 14.2 deg., 23.9 deg. and 27.1 deg. on a CuK$\alpha$-characteristic X-ray diffraction pattern), 2 parts of polyvinyl butyral ("BX-1", made by Sekisui Kagaku Kogyo K.K.) and 34 parts of cyclohexanone was subjected to dispersion for 10 hours in a sand mill, and then diluted with 60 parts of tetrahydrofuran to form a coating liquid for a charge generation layer. The coating liquid was applied by dipping onto the above-prepared intermediate layer and dried at 83° C. for 10 min. to form a 0.2 $\mu$m-thick charge generation layer.

Then, 50 parts of a triarylamine compound represented by a structural formula below:

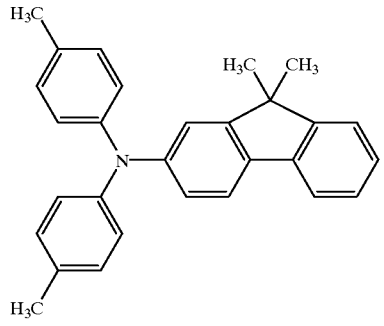

and 50 parts of a polycarbonate resin ("IUPILON Z-200", made by Mitsubishi Gas Kagaku K.K.) were dissolved in 400 parts of chlorobenzene to form a solution, which was then applied by dipping onto the above-formed charge generation layer and dried by heating at 117° C. for 1 hour to form a 15 $\mu$m-thick charge transport layer, thereby preparing an electrophotographic photosensitive member.

The above-prepared photosensitive member was set in a printer according to reversal development-type electrophotography ("Laser Writer 16/600 PS", made by Apple Computer, Inc.) and subjected to measurement of dark-part potential (Vd) and light-part potential (Vl) and evaluation with eyes of formed images in respective environments of normal temperature/normal humidity (25° C./50% RH), low temperature/low humidity (15° C./15% RH) and high temperature/high humidity (30° C./80% RH). The results are shown in Tables 1 and 2 appearing hereinafter together with those of Examples and Comparative Examples described hereinbelow.

As a result, as shown in Table 1, the photosensitive member provided sufficiently large contrasts between the dark-part potential (Vd) and the light-part potential (Vl) even in the low temperature/low humidity and high temperature/high humidity environments. Further, as shown in Table 2, there were formed high-quality images which were free from unnecessary black spots or fog and free from interference fringes even in halftone images.

EXAMPLE 2

A coating liquid for an intermediate layer was prepared in the same manner as in Example 1 except for increasing the amount of the deionized water to 280 parts and adding 30 parts of tetrahydrofuran. The coating liquid for an intermediate layer was applied in a similar manner as in Example 1 to form a 1.3 μm-thick intermediate layer showing Rz=0.4 μm.

Thereafter, a charge generation layer and a charge transport layer were formed in the same manner as in Example 1 to form a photosensitive member, which was then evaluated in the same manner as in Example 1. As a result, the photosensitive member exhibited sufficiently large contrasts between the dark-part potential (Vd) and light-part potential (Vl) even in the low temperature/low humidity and high temperature/high humidity environments as shown in Table 1, and high-quality images were formed, which were free from unnecessary black spots or fog and free from interference fringes even in halftone images, as shown in Table 2.

EXAMPLE 3

A coating liquid for an intermediate layer was prepared by dispersing 50 parts of alumina particles (Dav=20 nm) ("Aluminum Oxide C", made by Nippon Aerosil K.K.) together with 200 parts of deionized water and 0.25 part of polyoxyethylene alkylphenyl ether nonionic surfactant ("EA120", made by Daiichi Kogyo Yakuhin K.K.), under stirring for 60 min.

A photosensitive member was prepared and evaluated in the same manner as in Example 1 except for forming a 2 μm-thick intermediate layer (Rz=0.6 μm) by using the above-prepared coating liquid for an intermediate layer. As a result, the photosensitive member exhibited sufficiently large contrasts between the dark-part potential (Vd) and light-part potential (Vl) even in the low temperature/low humidity and high temperature/high humidity environments as shown in Table 1, and high-quality images were formed, which were free from unnecessary black spots or fog and free from interference fringes even in halftone images, as shown in Table 2.

EXAMPLE 4

A coating liquid for an intermediate layer was prepared in the same manner as in Example 3 except for increasing the amount of the deionized water to 280 parts and adding 30 parts of tetrahydrofuran.

A photosensitive member was prepared and evaluated in the same manner as in Example 1 except for forming a 1.3 μm-thick intermediate layer (Rz=0.5 μm) by using the above-prepared coating liquid for an intermediate layer. As a result, the photosensitive member exhibited sufficiently large contrasts between the dark-part potential (Vd) and light-part potential (Vl) even in the low temperature/low humidity and high temperature/high humidity environments as shown in Table 1, and high-quality images were formed, which were free from unnecessary black spots or fog and free from interference fringes even in halftone images, as shown in Table 2.

COMPARATIVE EXAMPLE 1

A coating liquid for an intermediate layer was prepared by dissolving 10 parts of alcohol-soluble copolyamide resin ("AMILAN CM-8000", made by Toray K.K.) in a mixture solvent of methanol 60 parts and n-butanol 40 parts.

A photosensitive member was prepared and evaluated in the same manner as in Example 1 except for forming a 0.7 μm-thick intermediate layer (Rz=0.07 μm) by using the above-prepared coating liquid for an intermediate layer and drying the applied coating liquid at 90° C. for 10 min.

As a result, the photosensitive member exhibited large contrasts between Vd and Vl in the environments of low temperature/low humidity and normal temperature/normal humidity as shown in Table 1, but resulted in halftone images accompanied with interference fringes in all environments and images accompanied with fog presumably due to charge injection from the support in the high temperature/high humidity environment, as shown in Table 2.

COMPARATIVE EXAMPLE 2

An aluminum cylinder (OD=30 mm×L=254 mm) formed by drawing was coated by dipping with a coating liquid formed by dissolving 167 parts of phenolic resin ("PLI-O-PHEN", made by Dai Nippon Ink Kagaku Kogyo K.K.) in 100 parts of methyl cellosolve and dispersing 200 parts of electroconductive ultrafine particles (primary particle size=50 nm) and 3 parts of silicone resin particles (average particle size=2 μm), followed by drying, to form a 15 μm-thick electroconductive layer.

The electroconductive layer was then coated with the coating liquid for an intermediate layer prepared in Comparative Example 1 to form a 0.7 μm-thick intermediate layer (Rz=0.07 μm) similarly as in Comparative Example 1.

Thereafter, a charge generation layer and a charge transport layer were formed in the same manner as in Example 1 to form a photosensitive member, which was then evaluated in the same manner as in Example 1.

As a result, the photosensitive member exhibited large contrasts between Vd and Vl in the environments of low temperature/low humidity and normal temperature/normal humidity as shown in Table 1, but resulted in images accompanied with fog presumably due to charge injection from the support in the high temperature/high humidity environment, as shown in Table 2, while the images were free from interference fringes in halftone images.

COMPARATIVE EXAMPLE 3

A coating liquid was prepared in the same manner as in Example 1 except for increasing the amount of the deionized water to 1000 parts and decreasing the amount of the nonionic surfactant to 0.05 part.

A photosensitive member was prepared and evaluated in the same manner as in Example 1 except forming a 0.3 μm-thick intermediate layer (Rz=0.08 μm) by using the above-prepared coating liquid for an intermediate layer.

As a result, the photosensitive member exhibited large contrasts between Vd and Vl in the environments of low temperature/low humidity and normal temperature/normal humidity as shown in Table 1, but resulted in halftone images accompanied with interference fringes in all environments as shown in Table 2 while the resultant images were free from black spots or fog.

The results of evaluation in the above Examples and Comparative Examples are summarized in Tables 1 and 2 below.

TABLE 1

| | Dark-part and Light-part potentials | | | | | |
|---|---|---|---|---|---|---|
| | 25° C./50% | | 15° C./15% | | 30° C./80% | |
| Example | Vd (V) | Vl (V) | Vd (V) | Vl (V) | Vd (V) | Vl (V) |
| 1 | −695 | −150 | −695 | −160 | −665 | −125 |
| 2 | −695 | −160 | −695 | −165 | −665 | −125 |
| 3 | −695 | −145 | −695 | −165 | −670 | −130 |
| 4 | −695 | −145 | −695 | −165 | −670 | −130 |
| Comp. 1 | −690 | −140 | −690 | −160 | −620 | −110 |
| Comp. 2 | −690 | −130 | −690 | −160 | −640 | −115 |
| Comp. 3 | −695 | −130 | −690 | −130 | −655 | −120 |

TABLE 2

| | Image quality evaluation | | |
|---|---|---|---|
| Example | 25° C./50% RH | 15° C./15% | 30° C./80% |
| 1 | good | good | good |
| 2 | good | good | good |
| 3 | good | good | good |
| 4 | good | good | good |
| Comp. 1* | I.F. | I.F. | fog/I.F. |
| Comp. 2 | good | good | fog |
| Comp. 3* | I.F. | I.F. | I.F. |

*I.F. = interference fringes in halftone images.

EXAMPLE 5

A photosensitive member was prepared and evaluated in the same manner as in Example 1 except for using the aluminum cylinder after surface cutting to provide a surface roughness Rz=0.5 μm and applying thereon a coating liquid for an intermediate layer prepared in the same manner as in Example 1 except for increasing the stirring period to 60 min. to form a 0.5 μm-thick intermediate layer (Rz=0.3 μm).

As a result, the photosensitive member exhibited sufficiently large contrasts between the dark-part potential (Vd) and light-part potential (Vl) even in the low temperature/low humidity and high temperature/high humidity environments as shown in Table 3, and high-quality images were formed, which were free from unnecessary black spots or fog and free from interference fringes even in halftone images, as shown in Table 4.

EXAMPLE 6

A photosensitive member was prepared and evaluated in the same manner as in Example 5 except for using a coating liquid for an intermediate layer prepared by increasing the amount of the deionized water to 280 parts to form a 1 μm-thick intermediate layer (Rz=0.3 μm).

As a result, the photosensitive member exhibited sufficiently large contrasts between the dark-part potential (Vd) and light-part potential (Vl) even in the low temperature/low humidity and high temperature/high humidity environments as shown in Table 3, and high-quality images were formed, which were free from unnecessary black spots or fog and free from interference fringes even in halftone images, as shown in Table 4.

EXAMPLE 7

A photosensitive member was prepared and evaluated in the same manner as in Example 5 except for using a coating liquid for an intermediate layer prepared by using ethanol instead of the deionized water and using ethyl abietate (made by Tokyo Kasei K.K.) instead of the polyoxyethylene alkylphenyl ether nonionic surfactant to form a 0.5 μm-thick intermediate layer (Rz=0.3 μm).

As a result, the photosensitive member exhibited sufficiently large contrasts between the dark-part potential (Vd) and light-part potential (Vl) even in the low temperature/low humidity and high temperature/high humidity environments as shown in Table 3, and high-quality images were formed, which were free from unnecessary black spots or fog and free from interference fringes even in halftone images, as shown in Table 4.

EXAMPLE 8

A photosensitive member was prepared and evaluated in the same manner as in Example 5 except for using a coating liquid for an intermediate layer prepared by dispersing 50 parts of alumina particles (Dav=20 nm) ("Aluminum Oxide C", made by Nippon Aerosil K.K.) together with 200 parts of deionized water and 0.25 part of polyoxyethylene alkylphenyl ether nonionic surfactant ("EA120", made by Daiichi Kogyo Yakuhin K.K.), under stirring for 60 min., to form a 1 μm-thick intermediate layer (Rz=0.3 μm).

EXAMPLE 9

Figure 2:
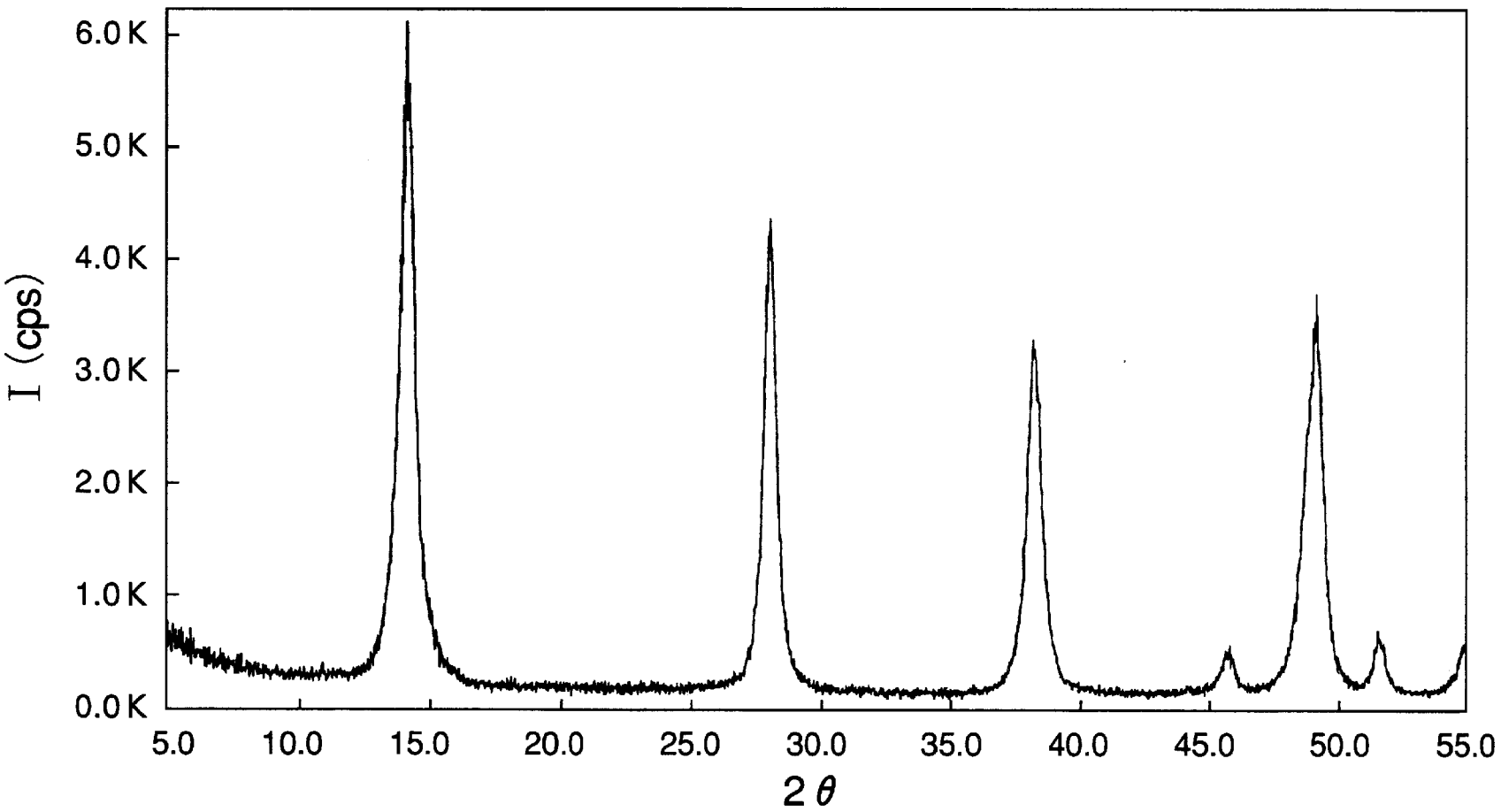
FIG. 2 reproduces an X-ray diffraction chart of an intermediate layer produced in Example 9.

Into a flask, 20 parts of aluminum tri-sec-butoxide was placed, and under stirring, 150 parts of deionized water was added thereto, followed by continued stirring for 10 min. after the addition. Thereafter, the whole content of the flask was transferred into a stainless steel bottle (volume 300 ml) of which the inner wall was coated with polytetrafluoroethylene, and after closing the bottle, was heated at 150° C. for 24 hours. Thereafter, 0.1 part of polyoxyethylene alkylphenyl ether nonionic surfactant ("EA120", made by Daiichi Kogyo Yakuhin K.K.) was added thereto to form a coating liquid for an intermediate layer. The coating liquid was applied onto a surface-cut aluminum cylinder in the same manner as in Example 5 to form a 0.5 μm-thick intermediate layer (Rz=0.3 μm). The intermediate layer exhibited an average primary particle size of 17 μm and provided a X-ray diffraction chart as shown in FIG. 2 representing boehmite crystal phase.

Thereafter, a charge generation layer and a charge transport layer were formed in the same manner as in Example 5 to form a photosensitive member, which was evaluated in the same manner as in Example 5.

As a result, the photosensitive member exhibited sufficiently large contrasts between the dark-part potential (Vd) and light-part potential (Vl) even in the low temperature/low humidity and high temperature/high humidity environments as shown in Table 3, and high-quality images were formed, which were free from unnecessary black spots or fog and free from interference fringes even in halftone images, as shown in Table 4.

COMPARATIVE EXAMPLE 4

A coating liquid for an intermediate layer was prepared in the same manner as in Example 5 except for increasing the amount of the deionized water to 2000 parts and decreasing the amount of the nonionic surfactant to 0.05 part.

A photosensitive member was prepared and evaluated in the same manner as in Example 5 except for forming a 0.1 μm-thick intermediate layer (Rz=0.3 μm) by using the above-prepared coating liquid for an intermediate layer.

As a result, the photosensitive member exhibited sufficiently large contrasts between the dark-part potential (Vd) and light-part potential (Vl) even in the low temperature/low humidity and high temperature/high humidity environments as shown in Table 3, but resulted in images accompanied with some black spots presumably due to charge injection from the support in the normal temperature/normal humidity and high temperature/high humidity environments, as shown in Table 4.

COMPARATIVE EXAMPLE 5

A coating liquid for an intermediate layer was prepared by dissolving 10 parts of alcohol-soluble copolyamide resin ("AMILAN CM-8000", made by Toray K.K.) in a mixture solvent of methanol 60 parts and n-butanol 40 parts.

A photosensitive member was prepared and evaluated in the same manner as in Example 5 except for forming a 0.7 μm-thick intermediate layer (Rz=0.3 μm) by using the above-prepared coating liquid for an intermediate layer and drying the applied coating liquid at 90° C. for 10 min.

As a result, the photosensitive member exhibited large contrasts between Vd and Vl in the environments of low temperature/low humidity and normal temperature/normal humidity as shown in Table 3, but resulted in images accompanied with fog over the whole area in the high temperature/high humidity environment as shown in Table 4.

COMPARATIVE EXAMPLE 6

A coating liquid for an intermediate layer was prepared by dissolving 50 parts of alcohol-soluble copolyamide resin ("AMILAN CM-8000", made by Toray K.K.) in a mixture solvent of methanol 100 parts and deionized water 100 parts, and adding 50 parts of alumina particles ("UA5305", made by Showa Denko K.K.) thereto, followed by ultrasonic wave application for dispersion.

A photosensitive member was prepared and evaluated in the same manner as in Example 5 except for applying the above-prepared coating liquid and drying by heating the applied coating liquid at 90° C. for 10 min. to form a 0.7 μm-thick intermediate layer.

As a result, the photosensitive member exhibited a remarkably lower dark-part potential (Vd) in terms of an absolute value in the high temperature/high humidity environment compared with those in the normal temperature/normal humidity and low temperature/low humidity environments as shown in Table 3, and resulted in images accompanied with many black spots in the high temperature/high humidity environment as shown in Table 4. The photosensitive member once having resulted in such black spots resulted in similar black spots even if it was then used in the normal temperature/normal humidity environment or in the low temperature/low humidity environment.

The results of evaluation in the above Examples and Comparative Examples are summarized in Tables 3 and 4 below.

TABLE 3

Dark-part and Light-part potentials

| | 25° C./50% | | 15° C./15% | | 30° C./80% | |
|---|---|---|---|---|---|---|
| Example | Vd (V) | Vl (V) | Vd (V) | Vl (V) | Vd (V) | Vl (V) |
| 5 | −690 | −130 | −690 | −160 | −660 | −120 |
| 6 | −695 | −130 | −695 | −165 | −660 | −120 |
| 7 | −690 | −140 | −690 | −165 | −660 | −120 |
| 8 | −695 | −140 | −695 | −165 | −665 | −125 |
| 9 | −690 | −130 | −690 | −160 | −660 | −120 |
| Comp. 4 | −690 | −130 | −690 | −130 | −655 | −120 |
| Comp. 5 | −690 | −140 | −690 | −160 | −620 | −110 |
| Comp. 6 | −690 | −140 | −690 | −160 | −590 | −105 |

TABLE 4

Image quality evaluation

| Example | 25° C./50% RH | 15° C./15% | 30° C./80% |
|---|---|---|---|
| 5 | good | good | slight fog |
| 6 | good | good | good |
| 7 | good | good | good |
| 8 | good | good | good |
| 9 | good | good | good |
| Comp. 1 | some black spots | good | some black spots |
| Comp. 2 | good | good | wholly fogged |
| Comp. 3 | good | good | many black spots |

What is claimed is:

1. An electrophotographic photosensitive member, comprising:

a support, an intermediate layer and a photosensitive layer disposed in this order, wherein the intermediate layer comprises aggregated particles having a composition represented by formula (1) below:

$$Al_2O_3.nH_2O \quad (1),$$

wherein n is a number of at least 0 representing a degree of hydration, and the intermediate layer has a thickness of at least 0.5 μm.

2. A photosensitive member according to claim 1, wherein the aggregated particles comprise boehmite crystal particles.

3. A photosensitive member according to claim 1 or 2, wherein the aggregated particles have an average primary particle size of 10 nm-100 nm.

4. A photosensitive member according to claim 1 or 2, wherein the intermediate layer contains at most 1 wt. % of organic compound, if any.

5. A photosensitive member according to claim 1 or 2, wherein the intermediate layer has a surface roughness of 0.1–1 $\mu$m in terms of a ten-point-average roughness.

6. A process for forming an electrophotographic photosensitive member, comprising the steps of:

applying onto a support a dispersion liquid containing particles having a composition represented by formula (1) below:

$$Al_2O_3.nH_2O \quad (1),$$

wherein n is a number of at least 0 representing a degree of hydration, drying under heating the dispersion liquid on the support to aggregate the particles, thereby forming an intermediate layer having a thickness of at least 0.5 $\mu$m, and forming a photosensitive layer on the intermediate layer, thereby forming an electrophotographic photosensitive member comprising the support, the intermediate layer and the photosensitive layer disposed in this order.

7. A process according to claim 6, wherein the particles in the dispersion liquid comprise boehmite crystal particles.

8. A process according to claim 6 or 7, wherein the particles in the dispersion liquid have an average particle size of 10 nm–100 nm.

9. A process according to claim 6 or 7, wherein the dispersion liquid applied on the support is heated at a temperature in a range of 90–350° C.

10. A process according to claim 6 or 7, wherein the particles in the dispersion layer has been produced from an organic aluminum compound.

11. A process according to claim 10, wherein the particles in the dispersion layer has been produced through hydrothermal synthesis.

12. A process cartridge comprising:

an electrophotographic photosensitive member and at least one means selected from the group consisting of charging means, developing means and cleaning means; said electrophotographic photosensitive member and said at least one means being integrally supported and detachably mountable to a main assembly of an electrophotographic apparatus, wherein said electrophotographic photosensitive member comprises a support, an intermediate layer and a photosensitive layer disposed in this order, wherein the intermediate layer comprises aggregated particles having a composition represented by formula (1) below:

$$Al_2O_3.nH_2O \quad (1),$$

wherein n is a number of at least 0 representing a degree of hydration, and the intermediate layer has a thickness of at least 0.5 $\mu$m.

13. An electrophotographic apparatus comprising: an electrophotographic photosensitive member, and charging means, developing means and transfer means respectively disposed opposite to the electrophotographic photosensitive member, wherein said electrophotographic photosensitive member comprises a support, an intermediate layer and a photosensitive layer disposed in this order, wherein the intermediate layer comprises aggregated particles having a composition represented by formula (1) below:

$$Al_2O_3.nH_2O \quad (1),$$

wherein n is a number of at least 0 representing a degree of hydration, and the intermediate layer has a thickness of at least 0.5 $\mu$m.

* * * * *

UNITED STATES PATENT AND TRADEMARK OFFICE

CERTIFICATE OF CORRECTION

PATENT NO. : 6,623,899 B2
DATED : September 23, 2003
INVENTOR(S) : Itaru Takaya et al.

It is certified that error appears in the above-identified patent and that said Letters Patent is hereby corrected as shown below:

Title page,
Item [57], ABSTRACT,
Line 3, "fee" should read -- free --.

Column 1,
Line 27, "ununiformity" should read -- a nonuniformity --;
Line 37, "of" should be deleted; and
Line 61, "electrophoto-graphic" should read -- electrophotographic --.

Column 3,
Line 23, "time-consuming" should read -- time-consuming, --.

Column 5,
Line 16, "$Al_2O_3.3H_2O$" should read -- $Al_2O_3 \cdot 3H_2O$ --; and
Line 32, "by" should read -- be --.

Column 10,
Line 31, "(20±0.2 dcg.)" should read -- 2θ±0.2 deg.) --.

Column 13,
Line 7, "except" should read -- except for --.

Column 17,
Line 40, "has" should read -- have --.

Column 18,
Line 2, "has" should read -- have --.

Signed and Sealed this

Sixteenth Day of March, 2004

JON W. DUDAS
*Acting Director of the United States Patent and Trademark Office*